United States Patent [19]

Kovacs

[11] 4,363,661

[45] Dec. 14, 1982

[54] METHOD FOR INCREASING MECHANICAL PROPERTIES IN DUCTILE IRON BY ALLOY ADDITIONS

[75] Inventor: Bela V. Kovacs, Bloomfield Hill, Mich.

[73] Assignee: Ford Motor Company, Dearborn, Mich.

[21] Appl. No.: 252,110

[22] Filed: Apr. 8, 1981

[51] Int. Cl.[3] ..... C21C 7/02

[52] U.S. Cl. ..... 75/130 R; 75/53; 75/58; 75/130 A

[58] Field of Search ..... 75/53, 58, 130 R, 130 A

[56] References Cited

U.S. PATENT DOCUMENTS

| | | | |
|---|---|---|---|
| 3,492,118 | 1/1970 | MicKelson | 75/130 R |
| 3,527,597 | 9/1970 | Dawson | 75/130 R |
| 3,663,212 | 5/1972 | Heine | 75/130 R |
| 3,798,027 | 3/1974 | DeFranco | 75/130 R |
| 3,997,338 | 12/1976 | Van Eeghem | 75/130 R |

OTHER PUBLICATIONS

Grigorovich, V. K., Russian Casting Production, vol. 12, pp. 557–561, (1963).

*Primary Examiner*—P. D. Rosenberg
*Attorney, Agent, or Firm*—Joseph W. Malleck; Olin B. Johnson

[57] ABSTRACT

A method is disclosed of making as-cast ductile iron wherein an iron melt having a chemistry capable of forming gray iron having flake graphite is treated with a nodularizing agent and solidified to provide a microstructure consisting substantially of a pearlite matrix containing uniformly distributed graphite nodules surrounded by ferrite. The iron melt is alloyed with: (a) at least one of 0.02–0.06% Sb and 0.02–0.08% Sn, (b) 0.001–0.0015% each of Ce and La, and (c) 0.5–1.0% Mn.

9 Claims, 15 Drawing Figures

METHOD FOR INCREASING MECHANICAL PROPERTIES IN DUCTILE IRON BY ALLOY ADDITIONS

BACKGROUND OF THE INVENTION

The pearlite content is an important metallurgical parameter in as-cast ductile iron. It is generally known that pearlite, which is a eutectoid structure comprised of alternate layers of ferrite and cementite ($Fe_3C$), influences the hardness, fatigue properties, wear characteristics and the machinability of a ductile iron casting. Although it is also known that pearlite affects the yield and tensile strength of an iron casting, it is not generally known how the pearlite can be conveniently controlled to approach pearlite contents in excess of 90%.

It is believed the pearlite content is determined by the interaction between the rate at which the casting is cooled after solidification and the chemical composition of the casting. Once the molding procedure is decided for a specific shaped casting, it is difficult to control the cooling rate. The cooling rate is largely determined by the size of the casting in cross-section. Heat treatment may be used to overcome the difficulty, but is usually undesirable because of cost and the extra processing steps required.

Thus, control of the chemical composition through alloying becomes a necessary and desirable method step to control pearlite content. It is desirable because of the advantages of economy and the possibility for more accurate predictability of the pearlite content.

One chemical ingredient that has been found successful in increasing the stabilization of pearlite in gray cast iron is that of sulfur. The pearlite content in a typically gray iron casting is very high because of the presence of sulfur inherent in the gray iron charge materials. In the production of ductile cast iron, however, the presence of sulfur is intentionally avoided because of its effect upon the graphite which inhibits the formation of graphite nodules and thereby lowers the fatigue stress capabilities of the cast iron. Ductile iron is designed to accept stress and thus the sulfur content must be kept at a level which will not interfere with the graphite shape.

Therefore, in as-cast ductile iron castings, the chemistry of the melt is placed under severe limitations which prevent the use of readily known pearlite stabilizers This problem is addressed and solved by the present invention.

SUMMARY OF THE INVENTION

The invention is a method of making as-cast ductile iron wherein an iron melt having a chemistry capable of forming gray iron having flake graphite is treated with a nodularizing agent and solidified to provide a microstructure consisting of a substantially pearlite matrix containing graphite nodules surrounded by ferrite. The improvement comprises alloying the iron melt with the following combination of pearlite stabilizers: (a) at least one of antimony (in the range of 0.02–0.04% by weight of the iron melt) and tin (in the range of 0.02–0.08% by weight of the iron melt), (b) 0.001–0.0015% each of both cerium and lanthanum, and (c) 0.5–1.0% manganese. The resulting as-cast ductile iron will have a yield strength at least 30% higher than conventional ductile iron for a given section thickness, and a hardness of at least 50% higher over that of conventional ductile iron.

The roles of the above elements in combination for the improvement of strength and hardness can be explained as follows: (a) antimony and tin segregate at the metal/graphite interface to serve as a diffusion barrier around the nodules, (b) manganese alloys $Fe_3C$ and delays cementite decomposition during and after the entectoid reaction, (c) cerium reduces or neutralizes the adverse effect of antimony and tin on graphite growth, and (d) lanthanum increases the nodule count, all uniquely cooperating to provide higher strength and hardness.

The amount of pearlite within a given shaped ductile iron casting can be optimized by increasing the amount of pearlite stabilizers within the ranges given for a specific section size. However, when the section size is increased, the optimum strength and pearlite content can be obtained by moderating the amounts of antimony or tin within the given ranges while maintaining the amount of manganese in the 0.8–1.0% range. The Sb, Sn, Mn, Ce and La preferably constitute together 0.2–1.0% of the melt.

It is preferable in carrying out the above method that (1) the melt be comprised of a substantially pure alloy of iron/silicon/manganese/carbon, with the carbon being in the range of 3.0–4.1%, the silicon being in the range of 1.8–2.8%, the manganese being in the range of 0.5–0.8%, and the remainder being substantially iron. Impurities such as sulfur and phosphorus are advantageously maintained respectively to the maximum of 0.015% and 0.06%; (2) manganese is preferably added in the form of an iron/manganese alloy; (3) tin or antimony is preferably added to the melt in an elemental form; (4) the nodularizing agent is preferably selected from the group consisting of magnesium, calcium, lithium, and is optimally magnesium added in the form of magnesium ferro silicon or as a relatively pure powder or block of magnesium; and (5) the rare earth additions of cerium and lanthanum are preferably added in equal amounts (they may be added to the melt independently or in a form alloyed with the magnesium ferro silicon).

DESCRIPTION OF THE DRAWINGS

FIG. 13 is a graphical illustration of yield and tensile strengths as a function of hardness.

DETAILED DESCRIPTION

Figure 1:
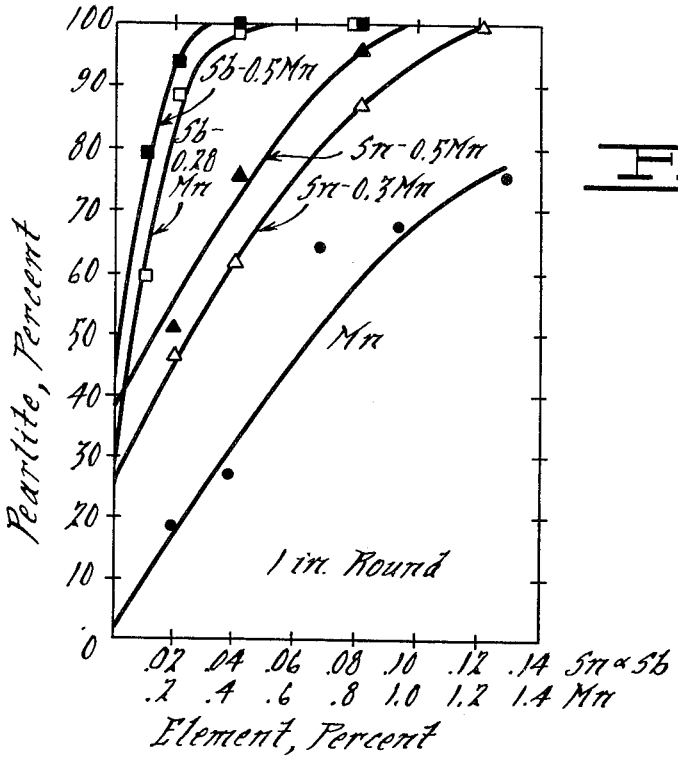
FIGS. 1 and 2 are graphical illustrations illustrating pearlite content as a function of the pearlite stabilizer additions being made in the one inch round bar section for FIG. 1 and in four inch cube sections for FIG. 2.

One principal mode by which pearlite becomes unstable during the solidification process of an iron melt is by the growth of ferrite about graphite nodules, the ferrite growing by cementite decomposition in the pearlitic matrix, and by carbon diffusion and precipitation as secondary graphitization on nodules. Thus, the prevention or inhibition of the cementite decomposition can have a significant effect upon stabilizing the pearlitic matrix.

As is known, ferrite forms in ductile iron castings by three different reactions. One of the reactions is the decomposition of austenite to ferrite and graphite at the nodule surfaces. A ferrite ring grows by the diffusion of carbon from the austenitic matrix through the ferrite ring onto the graphite nodule surface. The rest of the matrix transforms to pearlite. Further growth of the ferrite ring usually occurs by the decomposition of cementite at the ferrite/pearlite interface and by carbon diffusion to the nodule surface. In foundry jargon, this type of ferrite is referred to as bull's eye ferrite, which is derived from its image when looked at in a microphotograph. The nucleation of bull's eye ferrite is known to occur prior to pearlite formation. Delay of the nucleation of bull's eye ferrite can be an important aspect to the stabilization of pearlite transformation.

The second way in which ferrite is formed in ductile castings is by ferrite nucleation at the austenite grain boundary prior to the pearlite formation. This type of ferrite is called proeutectoid ferrite. It may occur in two forms, the grain boundary or the Widmanstatten form. The growth of the proeutectoid ferrite is diffusion controlled and both volume and grain boundry diffusion may be involved. The extent of the proeutectoid ferrite volume is limited by the long diffusion paths from the grain boundries to the carbon sinks (which are the graphite nodules).

The third way in which ferrite is formed in ductile castings is through segregation. Castings with three percent or more silicon content often contain high volumes of ferrite. The silicon level may reach the five percent level locally through segregation. With five percent silicon concentration, the ferrite is in equilibrium with austenite and graphite at temperatures higher than the eutectoid decomposition temperatures. If the ferrite is present prior to the eutectoid decomposition of austenite in the casting, it will be present at room temperature regardless of the cooling rate. This type of ferrite is called silico-ferrite.

Proeutectoid ferrite is seldom in significant amounts in as-cast structures. Silico-ferrite may occur in large volumes in the as-cast structure, but it is believed there is little that can be done about its volume content; extensive normalizing would be required to eliminate it and the heat treatment would be expensive. However, bull's eye ferrite is the most commonly occurring form in ductile iron and causes the most concern among ductile iron producers. This invention has discovered a method by which the growth of bull's eye ferrite can be controlled and thereby in turn control the decomposition of pearlite which has a direct effect upon the yield and tensile strength of the casting as well as its hardness and elongation.

The inventive method herein comprises essentially alloying certain pearlite stabilizer chemical ingredients with a conventional ductile iron melt so that upon solidification the as-cast iron will contain a pearlitic matrix having uniformly distributed graphite nodules with the bull's eye ferrite controlled by the presence of a film of segrated antimony or tin at the metal/graphite interface acting as a carbon diffusion barrier.

The stability of cementite is largely determined by the strength of the ionic bond between the carbide forming elements and the carbon. Atoms of elements, which are neighbors of iron in the periodic chart, can substitute for iron atoms in cementite. Those neighbors which have lower atomic numbers than iron such as manganese, chromium and titanium, form more stable carbides than $Fe_3C$ and can be used for pearlite stabilization. The more iron atoms that are substituted for in the cementite by these elements, the higher the pearlite content will be in the casting.

The use of manganese as one of the fundamental ingredients to pearlite stabilization has several advantages. If freely substitutes for iron in the cementite lattice. Manganese is inexpensive, readily available in scrap or charge materials, its concentration is easy to maintain in the casting, its recovery in the casting is high, and it does not have an adverse effect upon the graphite growth. Manganese, however, is known to have a highly segregating nature which may cause undesirable formation of eutectic carbides when it is used indiscriminately. During solidification, manganese is rejected by the advancing solid/liquid interface and the liquid is enriched with it. When the last of the liquid freezes at the cell boundaries, it may have a manganese concentration as high as five to six percent. At this level, the undesirable formation of eutectic carbide is likely to occur in the vicinity of the cell boundaries. Thus, manganese bulk concentration should preferably not exceed one percent in ductile iron casting. But, one percent manganese is insufficient to control pearlite decomposition alone.

Figure 2:
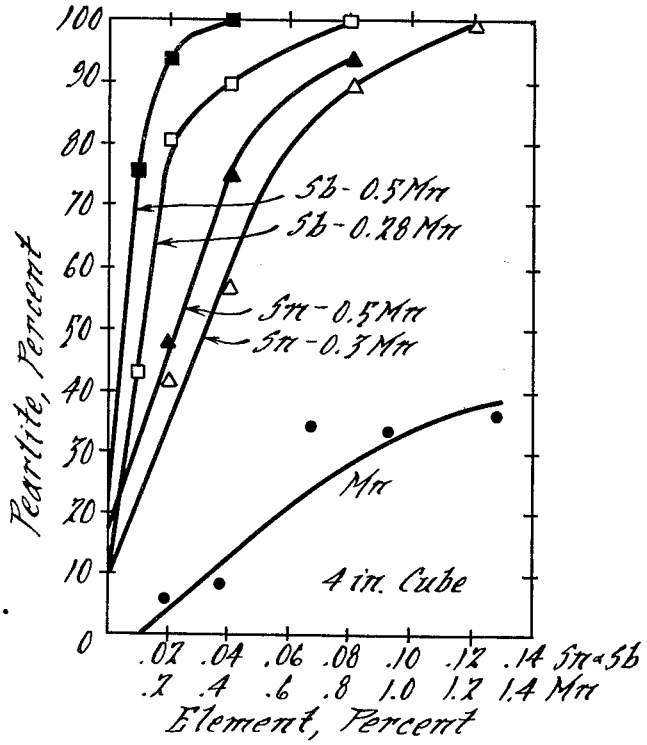
Figure 3:
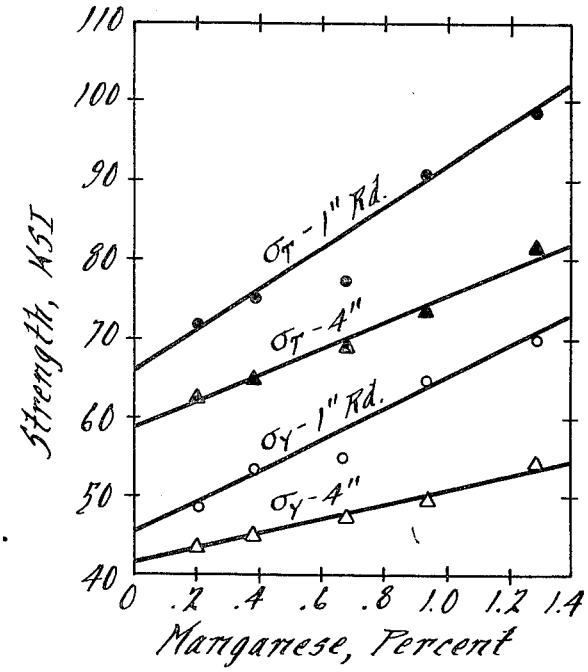
FIG. 3 is a graphical illustration of yield strength and tensile strength as a function of the manganese content in solid one inch round bar sections and in four inch cube sections.
Figure 4:
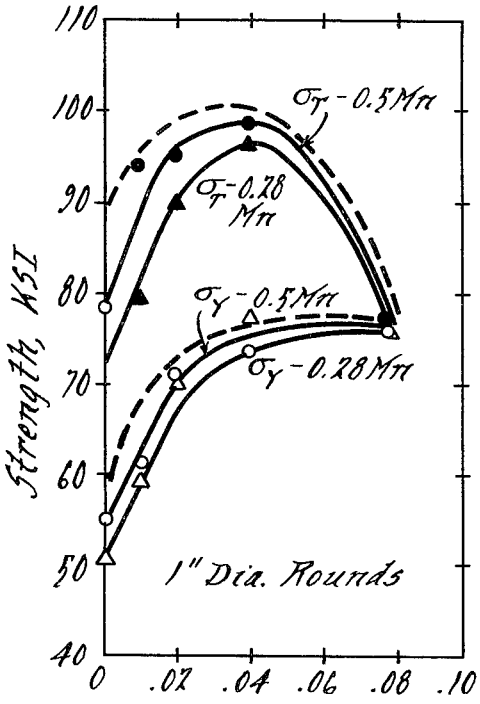
FIGS. 4 and 5 are graphical illustrations of yield and tensile strengths as a function respectively of the antimony and manganese contents in one inch round bar sections and as a function of the antimony and manganese contents in a four inch cube sections.

The presence of manganese in the solidified matrix has the following effect upon the eutectoid reactions: (a) it delays the nucleation of ferrite at the graphite/metal interface, (b) it lowers diffusivity of carbon in ferrite and thus slows down ferrite growth, and (c) it substitutes for iron in the $Fe_3C$, making it thermodynamically more stable and delaying cementite decomposition. All these effects increase the pearlite content in the as-cast structure. Unfortunately, as shown in FIGS. 1 and 2, the use of manganese alone as a pearlite stabilizer is not sufficient to increase the pearlite percentage much above 30 to 60% in the ranges that manganese is normally present in ductile cast iron. Since pearlite content is generally related to the yield strength, increasing only the amount of manganese in a conventional ductile cast iron is not sufficient to significantly raise the yield strength, as shown by FIG. 3, particularly in the larger cross-sectional castings.

It has been discovered that certain selected pearlite stabilizers in the form of antimony and tin, when used in conjunction with Mn, Ce and La, provide a synergistic effect which is significant in raising the pearlite content and accordingly the yield and tensile strengths of the as-cast ductile iron. Tin and antimony are not known as carbide formers, yet their effect on the microstructure is very similar to that of manganese. The mechanisms by which these elements stabilize pearlite is entirely different from those associated with manganese. It has been discovered by the use of scanning Auger microscopy that tin and antimony segregate at the graphite/metal interface. These tin and antimony rich shells around the nodules do two things to the ferrite formation: (a) they delay or prevent nucleation of ferrite by providing a substrate which is unsuitable for nucleation, or (b) form shells which may serve as an effective diffusion barrier and slow down carbon diffusion from the matrix to the nodule surface. It has been found that it is necessary, however, to add about four times as much tin as antimony to achieve the same effect on the microstructure or on the mechanical properties.

Both antimony and tin have an adverse effect on nodularity. Marked nodule degeneration has been observed, especially when antimony was added to a heat. The adverse effects of tin and antimony on nodules can be neutralized by the addition of cerium or the use of cerium bearing Mg/Fe/Si alloy for the nodularization. Lanthanum addition of approximately 0.0015% increases the nodule count.

To investigate and to corroborate the validity of the underlying concept of this method, certain test castings were made and analyzed to determine the effect of these chemical additives upon the pearlite matrix, the resulting yield strength as well as elongation and hardness, and other physical characteristics. The chemical content of the several castings prepared were designed to provide a wide range of chemical composition and cooling rates in ductile iron castings. A total of 20 heats were cast, all with varied chemistry. Three elements, manganese, tin and antimony, were added in varying amounts for pearlite stabilization. The heats were generally divided into three groups, one group included only manganese which was varied, another group including tin as the pearlite stabilizer which was varied in combination with two levels of manganese, and a third group in which antimony was varied in combination with two levels of manganese consisted of a step casting with cross-sections of $\frac{1}{8}$, $\frac{1}{4}$, $\frac{1}{2}$, 1 and 2 inches, a three inch cube, a four inch cube and two one-inch round bars. A total of 160 specimens were produced. Each of the 20 chemical compositions were studied at eight different cooling rates so that the effects of chemical composition variation on a given casting size could be analyzed.

The melting procedure employed for each of the heats used a magnesium oxide lined, coreless induction furnace. Charge materials were added to the induction furnace comprising sorrel pig iron, Armco iron, about 75% Fe/Si, 85% Fe/Mn, Mg/Fe/Si (containing 8% Mg, 0.1% Ce and 0.1% La), and high purity antimony and tin. The pig iron was melted and the Armco iron was added. Ferro silicon and ferro manganese were added when the liquid iron temperature reached about 2625° F. (1440° C.). The bath was superheated to 2830° F. 1555° C.) and cooled to 2750° F. (1510° C.), at which temperature it was transferred into a preheated ladle. One percent nodularizing agent, 0.75% innoculant (75% grade Fe/Si), and the appropriate amount of Sb or Sn were added to the ladle at the time of the transfer. All heats were cast within three minutes after the nodularizing treatment.

To determine the pearlite content, a Quantimet B Quantitative Television Microscope (QTM) was used. The results of the examination are summarized in Table 2. The data was calculated by averaging the readings of 50 fields in each sample. The QTM was sensitive to the rounding of the edges of the samples and to rounding of metal/graphite interface during polishing.

Tracings of the manganese, tin and antimony distribution in the castings were made by using an ERL-EMX electron microprobe. The manganese tracing showed a significant increase of manganese content in the cell boundaries. In extreme cases, the manganese content in the cell boundaries was estimated to be ten times higher than the bulk concentration. The manganese levels near the graphite nodules were generally the lowest. The antimony distribution was uniform. In a few samples, such as sample 16, discrete antimony rich particles appeared which are believed to be $Mg_3Sb_2$. Magnesium antimonide is a compound occurring in antimony treated nodular iron. It causes embrittlement in the castings. The silicon distribution was the highest at the metal graphite interface and lowest at the cell boundaries.

It was concluded that if the pearlite stabilization was due to microsegregation of the solute, the x-ray beam would not be sensitive enough to detect it because of the large volume covered by the beam. It was estimated that the x-ray beam which was used with the electron microprobe penetrated the sample to the extent of several thousand atomic layers and the diameter of the beam was in the order of 1–1.5 microns. Thus, the use of Auger electrons would be more informative. Samples of the square bars were fractured in ultra-high vacuum and the fractured surface was examined by a Physical Electronics Incorporated, 545 Auger Microprobe. The Auger electrons penetrated the surface to about 4–5 atomic layers only. This was significant. The fracture was very seldom transgranularly through the graphite nodules, but rather intergranularly following the graphite/metal interface. With the Auger beam it was possible to examine the surface of the sockets from which the nodules were pulled out during the fracture. It was discovered through this microprobe that at the graphite/metal interface the surface of the sockets was highly concentrated with antimony or tin. The thickness of the antimony shell was observed to be about 40 angstroms, and the solute concentration was about 25 atomic percent.

In order to determine the origin of the tin or antimony rich shells around the nodules, one inch cube samples of test specimens #9 and #16 were normalized at 1900° (1040° C.) for six days in an inert atmosphere. The presence of tin and antimony in the shell area was still evident after the heat treatment. It was concluded that if the shell was stable at 1900° F. for six days, it would likely form during solidification.

FIG. 1 and Table 3 show that the combination of 0.5% manganese and 0.03% antimony produces a nearly fully pearlitic matrix in the four inch cube casting. The pearlite content of the same cube without antimony is estimated from the Figure to be about 16%. Approximately 3–4 times more tin than antimony has to be added to the base metal to obtain the same pearlite content as shown in FIGS. 1 and 2.

As shown in FIG. 1, both antimony and tin are very effective promoters of a pearlitic matrix. In the four inch cube, a nearly ferritic matrix was changed to fully pearlitic by the addition of 0.04% antimony or 0.08% tin in combination with 0.5% manganese. The effects of manganese, antimony and tin additions on the strength properties of ductile as-cast iron are illustrated in FIGS. 3, 4, 5, 6 and 7. From these Figures it can be seen that the yield and tensile strengths are linearly proportional to the amount of manganese added. The addition of manganese in excess of one percent, however, increases the risk of eutectic carbide formation. Therefore, the maximum addition of manganese for purposes of this invention is substantially about one percent (see broken line of FIGS. 4–7); within the designated maximum of one percent manganese, the pearlite content in the four inch cube was about 30% (see FIG. 2). If a highly pearlitic matrix is desired in castings of a large section, it is clear that the manganese addition alone is not sufficient because 30% is an extremely poor pearlitic content.

Figure 5:
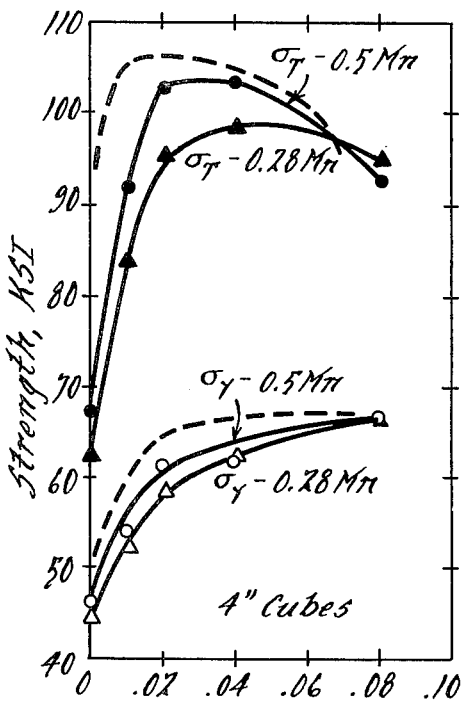

The addition of antimony up to 0.04% increases both the pearlite content and the strength properties. Additions in excess of 0.04% will promote the formation of magnesium antimonide and cause embrittlement in the castings. This embrittlement is evident from the tensile strength curves of FIGS. 4 and 5. In the one inch bars, at the 0.08% antimony level, the yield and tensile strength are almost identical, indicating very little ductility. More than 0.04% antimony addition is less detrimental in the larger sections, such as the four inch cubes as shown in FIG. 5. Nevertheless, it is preferred that the antimony content be kept below the 0.04% level, even in combination with rare earths.

Figure 6:
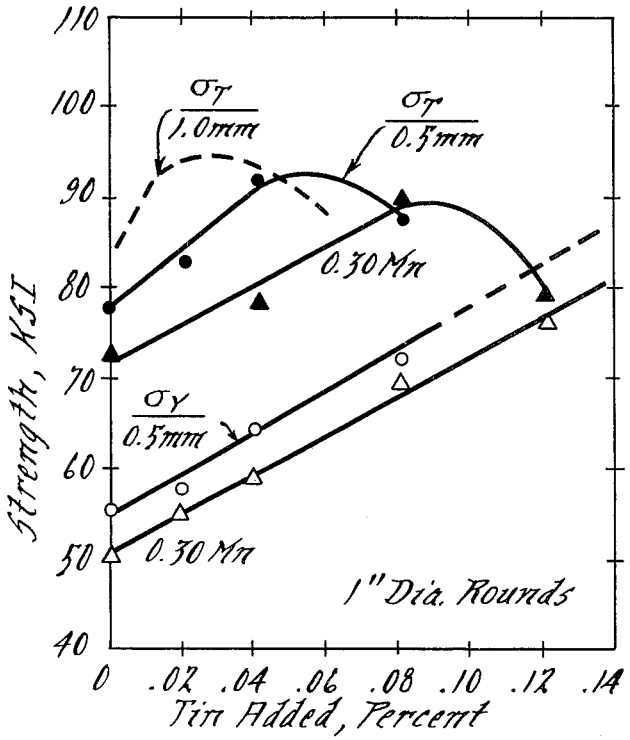
FIGS. 6 and 7 are graphical illustrations similar to that of FIGS. 4 and 5, illustrating the variation of yield and tensile strengths as a the function of the tin and manganese contents in the same type of sections.
Figure 7:
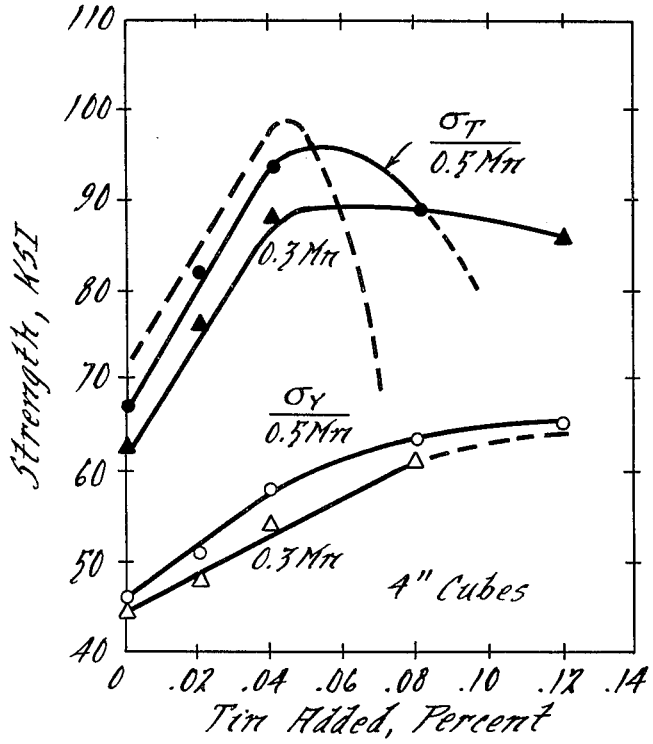
Figure 8:
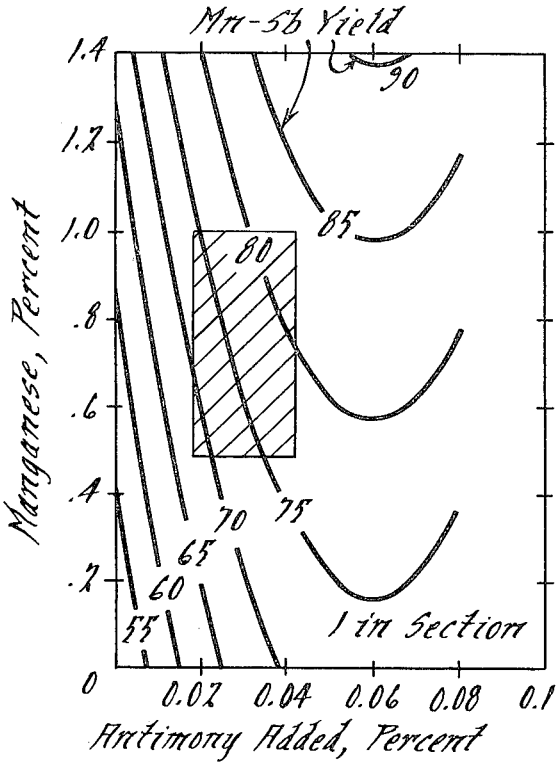
FIGS. 8 and 9 are graphical illustrations of computer predicted yield strengths as a function of the pearlite stabilizer addition, FIG. 8 being for an antimony addition and FIG. 9 being for a tin addition.
Figure 9:
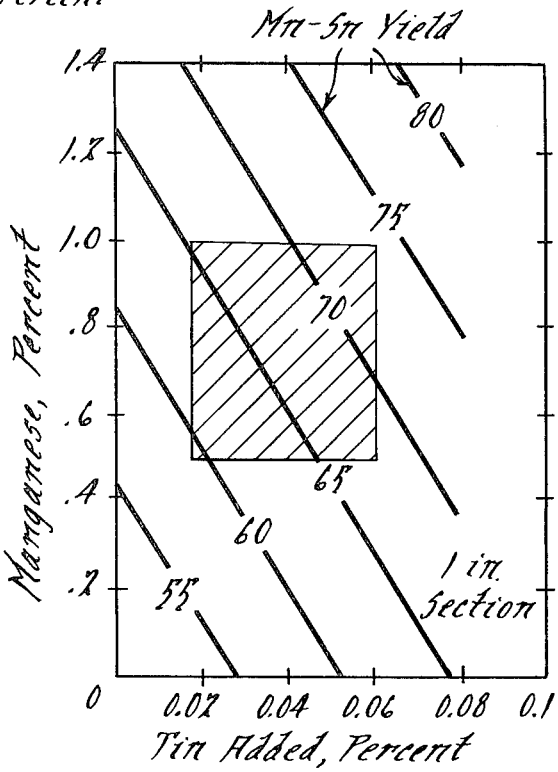
Figure 10:
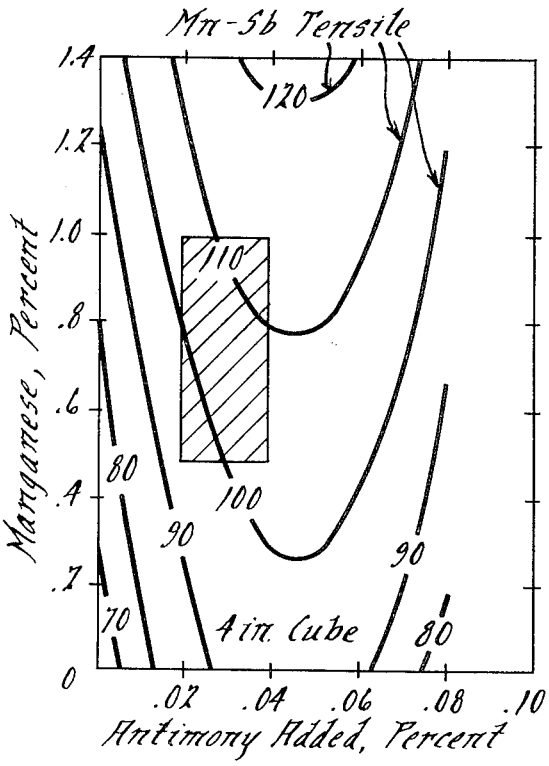
FIGS. 10 and 11 are also graphical illustrations of computer predicted tensile strengths as a function of the pearlite stabilizer addition, FIG. 10 being for the antimony addition and FIG. 11 being for the tin addition, both figures being for four inch cube sections.
Figure 11:
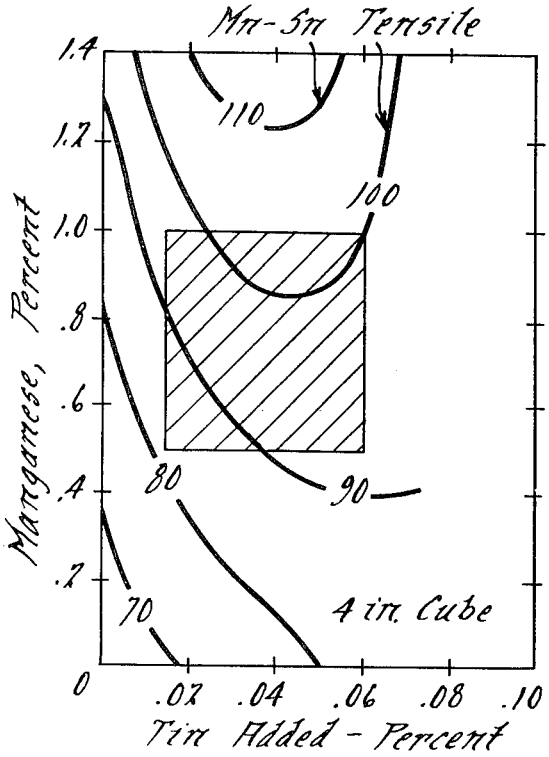

FIGS. 6 and 7 show similar characteristics for the tin additions. Both yield and tensile strengths are increased significantly with increasing tin content up to approximately 0.06% tin. Concentrations higher than 0.06% will reduce the ductility of the castings.

It is interesting to note from FIGS. 3–7 how the yield and tensile strength are strongly dependant upon the pearlite content, as well as nodule count. However, pearlite content is not a predictor of strength in all cases. Higher nodule count causes an increase in the yield and tensile strength. The yield strength in the four inch castings, for instance, is lower than in the one inch bars with the same pearlite content. The difference is attributed to the larger nodule size associated with the lower solidification rate in the four inch cube casting. This enables the tolerable range of pearlite stabilizers to vary, depending upon the cross-section size of the casting. For example, with the addition of tin, it is possible that higher percentages of tin than 0.08% are effective in the larger sections when working with lower percentages of manganese, such as less than 0.5% manganese. However, within the preferred range of 0.5–1.0% manganese, the operable range for the tin addition is 0.04–0.08%, 0.08% being particularly suitable when working in combination with 0.5% manganese and 0.04% tin being particularly suitable when working with 0.8–1% manganese in the four inch cube sections. When working with thinner sections, the lower end of the operable range of tin is desirable, such as about 0.04% tin, whether 0.5% or 0.8% manganese is employed. Similarly, acceptably high strength levels are achieved in the larger section such as four inch cube with antimony additions of greater than 0.04% such as 0.06% without a significant drop in the ductility of the material.

Accordingly, the tin and antimony additions, in combination with manganese, can be increased slightly when working with progressively thicker sections of the as-cast material. Embrittlement apparently does not proceed as rapidly when working with the thicker sections. It also appears from these figures that, within the preferred ranges indicated, the higher the manganese, the lower the tin or antimony addition to achieve equivalent strength levels.

FIGS. 8 to 11 are computer predicted yield and tensile strength shown as a function of the pearlite stabilizer additions. The set of lines represent strength in Ksi units. The regression computer model for the prediction of strength properties had the following form: $Y=A_0+A_1X_1+A_2X_2+\ldots+A_nX_n$, where Y is the predicted property and X variables are the predictors. In the case of yield and tensile strength, the pearlite stabilizer additions, the cooling rate, and the length of the eutectic arrest were the predictors. The regression coefficients for the yield and tensile strengths were 0.096 and 0.86, respectively. A relationship of this type is useful for the determination of the optimum combination among pearlite stabilizers. Superimposed upon the FIGS. 8 to 11 is a zone of the preferred compositional ranges of the material suggested to be employed, thus indicating the general strength levels that can be obtained.

Figure 12:
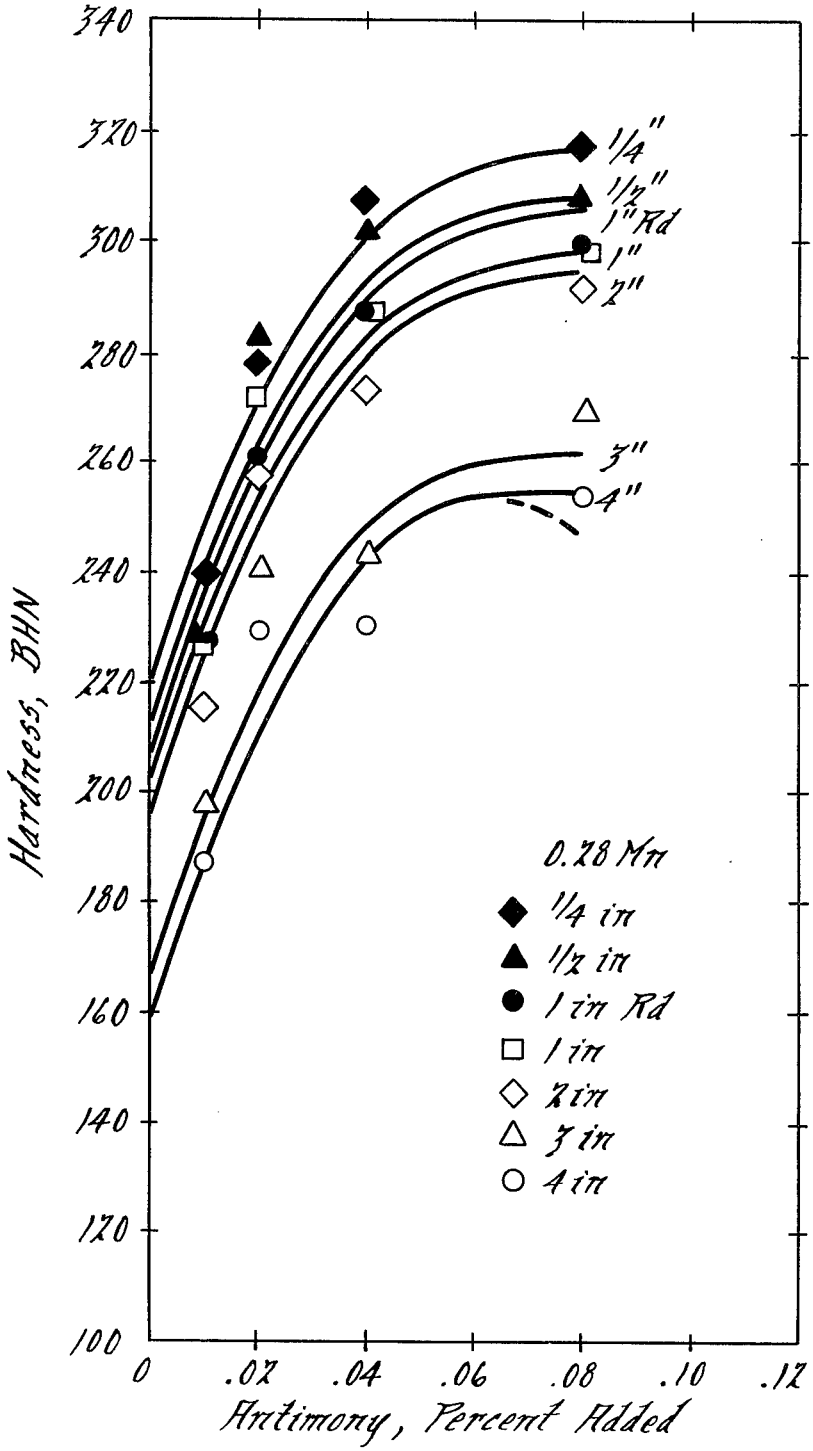
FIG. 12 is a graphical illustration of hardness as a function of the antimony addition.
Figure 1:
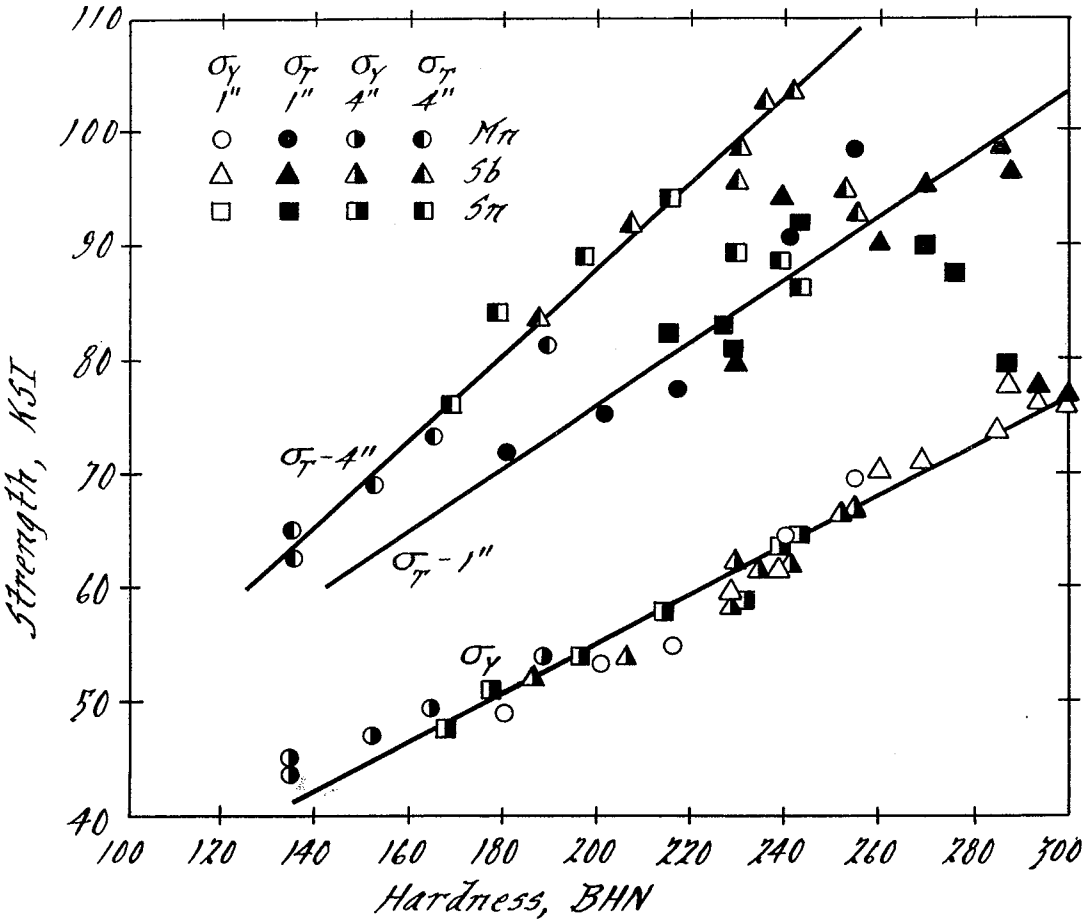
Figure 14:
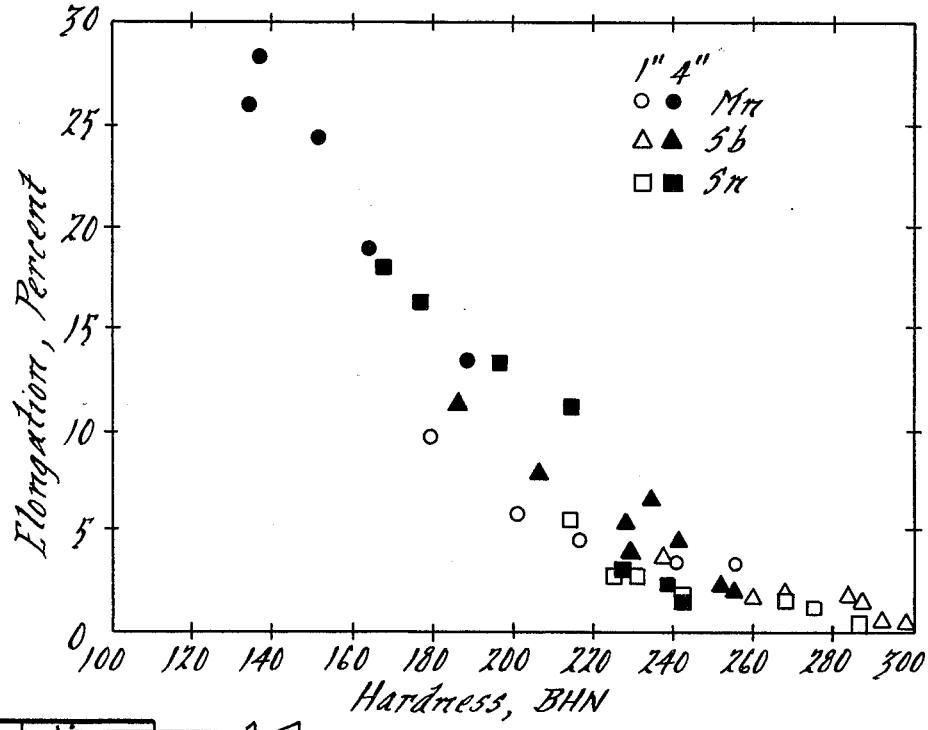
FIG. 14 is a graphical illustration of elongation for the materials tested as a function of the hardness.

The relationship between BHN hardness and the strength properties is significant. As shown in FIG. 12, the effect of antimony additions on the hardness is illustrated. The hardness increases rapidly with additions up to 0.04% and then levels off. Additions higher than 0.04% do not increase the hardness significantly because the matrix is fully pearlitic at these levels. Hardness is a good predictor of the yield strengths, regardless of how the hardness was achieved, whether thermally or chemically. The variation of strength as a function of hardness is shown in FIG. 13 and the variation of elongation with hardness is shown in FIG. 14. This data suggests that the additions of over one percent manganese, 0.06% tin and 0.04% antimony are detrimental to the strength properties which is related to hardness.

Figure 15:
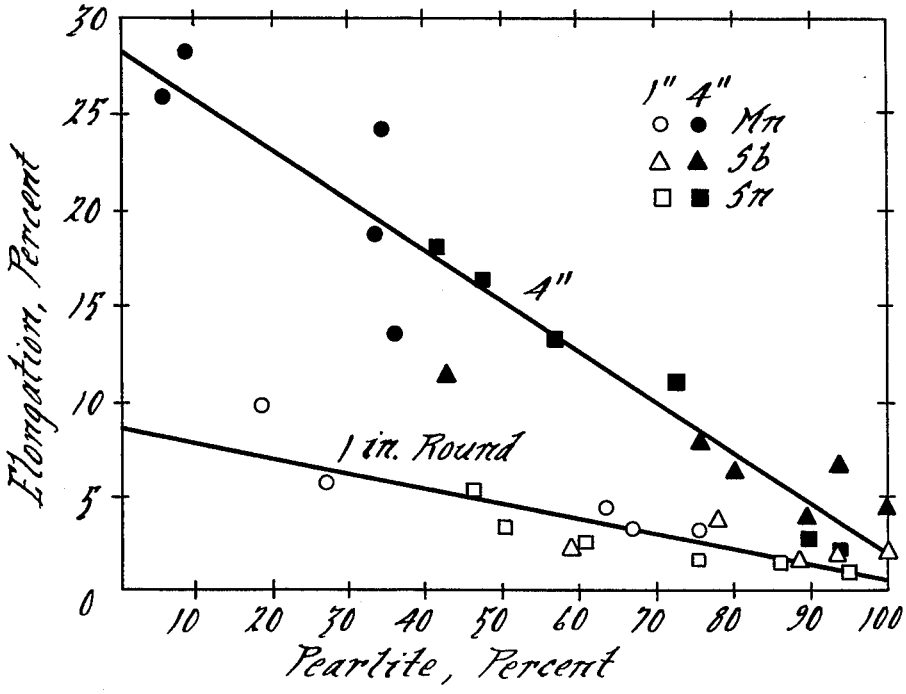
FIG. 15 is a graphical illustration of elongation for the materials tested as a function of the pearlite content in one inch round bars and in the four inch cubes.

The elgonation characteristic is also dependent on the matrix structure as well as size of the casting cross-section. In FIG. 15, the elongation is shown as a function of pearlite content for one inch rounds and for four inch cube. This particular Figure demonstrates that elongation is linearly proportional to pearlite content.

These test data indicate that manganese additions, in proper combination with tin and antimony, can produce highly pearlitic castings of high strength in the as-cast condition. Tin additions in excess of 0.06% and antimony additions in excess of 0.04% may begin to cause embrittlement of the castings. Manganese addition alone will not produce a highly pearlitic ductile iron casting of three inches or larger cross-section without supplementary heat treatment. However, when manganese is used in combination with tin and antimony, the pearlite is stabilized by a mechanism which prevents carbon diffusion from the matrix onto the graphite surface irrespective of the cross-sectional size.

Although the addition of 0.001–0.002% Ce does not seem to affect the pearlite content, it helps increase the strength properties by neutralizing the adverse effects of Sb on graphite growth. The 0.001–0.002% La addition increases the nodule count, thus, increases the strength properties. The La addition is especially beneficial for large section sizes.

TABLE I

CHEMICAL ANALYSIS
(In % By Weight of the Casting)

| Heat No. | C.E.* | C. | Si. | Mn. | S. | Mg. | Sn. | Sb. |
|---|---|---|---|---|---|---|---|---|
| NODULAR IRON | | | | | | | | |

TABLE I-continued

| Heat No. | C.E.* | C. | Si. | Mn. | S. | Mg. | Sn. | Sb. |
|---|---|---|---|---|---|---|---|---|
| | | | CHEMICAL ANALYSIS (In % By Weight of the Casting) | | | | | |
| 1 | 4.61 | 3.75 | 2.57 | .20 | .005 | .031 | — | — |
| 2 | 4.69 | 3.78 | 2.43 | .38 | .005 | .026 | — | — |
| 3 | 4.59 | 3.73 | 2.57 | .67 | .004 | .035 | — | — |
| 4 | 4.59 | 3.76 | 2.50 | .93 | .005 | .030 | — | — |
| 5 | 4.63 | 3.80 | 2.59 | 1.28 | .005 | .029 | — | — |
| 6 | 4.62 | 3.76 | 2.57 | .30 | .005 | .029 | .024 | — |
| 7 | 4.62 | 3.76 | 2.59 | .30 | .006 | .029 | .035 | — |
| 8 | 4.61 | 3.75 | 2.57 | .30 | .005 | .029 | .066 | — |
| 9 | 4.61 | 3.75 | 2.57 | .29 | .006 | .026 | .110 | — |
| 10 | 4.63 | 3.77 | 2.59 | .50 | .005 | .029 | .025 | — |
| 11 | 4.63 | 3.77 | 2.59 | .50 | .004 | .030 | .034 | — |
| 12 | 4.62 | 3.76 | 2.57 | .50 | .006 | .028 | .065 | — |
| 13 | 4.57 | 3.71 | 2.59 | .25 | .005 | .029 | — | .009 |
| 14 | 4.56 | 3.70 | 2.59 | .28 | .005 | .025 | — | .019 |
| 15 | 4.58 | 3.75 | 2.50 | .28 | .005 | .026 | — | .040 |
| 16 | 4.64 | 3.77 | 2.62 | .29 | .006 | .032 | — | .072 |
| 17 | 4.54 | 3.77 | 2.31 | .52 | .004 | .026 | — | .009 |
| 18 | 4.61 | 3.78 | 2.49 | .52 | .006 | .030 | — | .019 |
| 19 | 4.47 | 3.70 | 2.31 | .52 | .006 | .031 | — | .037 |
| 20 | 4.60 | 3.74 | 2.59 | .51 | .005 | .030 | — | .072 |
| | | | GRAY IRON | | | | | |
| 21 | 4.24 | 3.60 | 1.92 | .53 | .105 | — | — | — |
| 22 | 4.44 | 3.65 | 2.38 | .57 | .112 | — | .032 | — |
| 23 | 4.27 | 3.54 | 2.18 | .55 | .113 | — | .061 | — |
| 24 | 4.20 | 3.51 | 2.06 | .55 | .104 | — | — | .030 |
| 25 | 4.30 | 3.54 | 2.28 | .55 | .102 | — | — | .055 |

*Carbon equivalent (sum of carbon + ⅓ silicon).

TABLE II

| Heat No. | ⅛* | ¼* | ½ | 1 | 1 Rd | 2 | 3 | 4 |
|---|---|---|---|---|---|---|---|---|
| | PEARLITE CONTENT (In % volume as a Fraction of Matrix) SECTION SIZE, INCHES | | | | | | | |
| 1 | 92 | 61 | 50 | 34 | 19 | 16 | 10 | 5 |
| 2 | 85 | 69 | 56 | 35 | 27 | 18 | 12 | 8 |
| 3 | 100 | 86 | 69 | 56 | 64 | 44 | 34 | 34 |
| 4 | 90 | 90 | 78 | 70 | 67 | 56 | 31 | 33 |
| 5 | 87 | 94 | 83 | 75 | 76 | 72 | 41 | 36 |
| 6 | 96 | 74 | 66 | 57 | 46 | 41 | 33 | 43 |
| 7 | 94 | 71 | 74 | 70 | 62 | 65 | 58 | 56 |
| 8 | 94 | 93 | 93 | 91 | 86 | 91 | 87 | 88 |
| 9 | 100 | 100 | 100 | 100 | 100 | 100 | 100 | 99 |
| 10 | 85 | 73 | 68 | 63 | 51 | 53 | 44 | 48 |
| 11 | 92 | 79 | 82 | 80 | 75 | 79 | 73 | 75 |
| 12 | 94 | 99 | 97 | 96 | 95 | 97 | 94 | 93 |
| 13 | 87 | 65 | 69 | 66 | 59 | 59 | 52 | 43 |
| 14 | 83 | 80 | 91 | 89 | 88 | 85 | 77 | 80 |
| 15 | 80 | 96 | 98 | 98 | 98 | 98 | 89 | 88 |
| 16 | 94 | 97 | 99 | 100 | 100 | 100 | 100 | 100 |
| 17 | 90 | 86 | 82 | 85 | 79 | 80 | 73 | 76 |
| 18 | 86 | 91 | 9 | 95 | 94 | 94 | 91 | 94 |
| 19 | 91 | 100 | 100 | 100 | 100 | 99 | 99 | 99 |
| 20 | 100 | 100 | 100 | 100 | 100 | 100 | 100 | 100 |
| 21 | 99 | 99 | 99 | 99 | 99 | 99 | 97.2 | 96.6 |
| 22 | 99 | 99 | 99 | 99 | 99 | 99 | 99 | 98.8 |
| 23 | 99 | 99 | 99 | 99 | 99 | 99 | 99 | 99 |
| 24 | 99 | 99 | 99 | 99 | 99 | 99 | 99 | 99 |
| 25 | 99 | 99 | 99 | 99 | 99 | 99 | 99 | 99 |

*In the ⅛ and ¼ sections some eutectic carbide was observed and was included in the pearlite content.

TABLE III

| Heat No. | ⅛ | ¼ | ½ | 1 | 1 Rd | 2 | 3 | 4 |
|---|---|---|---|---|---|---|---|---|
| | HARDNESS DATA, BHN* SECTION SIZE, INCHES | | | | | | | |
| 1 | 469 | 236 | 192 | 177 | 180 | 164 | 145 | 135 |
| 2 | 492 | 254 | 197 | 187 | 201 | 171 | 148 | 137 |
| 3 | 448 | 260 | 228 | 215 | 207 | 204 | 158 | 145 |
| 4 | 493 | 309 | 249 | 238 | 241 | 219 | 268 | 165 |
| 5 | 519 | 316 | 267 | 250 | 255 | 246 | 247 | 189 |

TABLE III-continued

| Heat No. | ⅛ | ¼ | ½ | 1 | 1 Rd | 2 | 3 | 4 |
|---|---|---|---|---|---|---|---|---|
| | HARDNESS DATA, BHN* SECTION SIZE, INCHES | | | | | | | |
| 6 | 515 | 232 | 226 | 212 | 215 | 207 | 179 | 168 |
| 7 | 436 | 246 | 240 | 234 | 229 | 226 | 207 | 197 |
| 8 | 461 | 279 | 277 | 268 | 269 | 253 | 240 | 229 |
| 9 | 403 | 309 | 302 | 290 | 287 | 276 | 247 | 243 |
| 10 | 448 | 260 | 229 | 221 | 227 | 207 | 187 | 178 |
| 11 | 454 | 274 | 254 | 249 | 243 | 241 | 223 | 215 |
| 12 | 437 | 297 | 287 | 283 | 275 | 267 | 248 | 239 |
| 13 | 357 | 239 | 229 | 215 | 229 | 215 | 197 | 187 |
| 14 | 352 | 278 | 282 | 258 | 260 | 258 | 240 | 229 |
| 15 | 333 | 307 | 302 | 272 | 287 | 272 | 242 | 230 |
| 16 | 330 | 316 | 307 | 291 | 299 | 291 | 268 | 253 |
| 17 | 490 | 300 | 254 | 242 | 239 | 242 | 217 | 207 |
| 18 | 316 | 305 | 285 | 271 | 269 | 271 | 253 | 235 |
| 19 | 484 | 314 | 286 | 278 | 285 | 278 | 253 | 241 |
| 20 | 421 | 324 | 304 | 293 | 293 | 293 | 269 | 255 |

*In the ⅛ and ¼ sections $R_c$ measurements were taken and converted to BHN.

I claim:

1. In a method of making an as-cast ductile iron casting, wherein a basic melt of carbon, silicon, manganese and iron is treated with a nodularizing agent and cooled to provide a microstructure consisting substantially of a pearlitic matrix containing cementite and graphite nodules surrounded by ferrite, the improvement comprising:

alloying said melt with the following combination of pearlitic stabilizers in percentage weight of the melt: (a) at least one of 0.02–0.06% Sb and 0.02–0.08% Sn, (b) 0.001–0.0015% Ce and 0.001–0.0015% La, and (c) 0.5–1.0% manganese.

2. The method as in claim 1, wherein the resulting as-cast ductile iron has a yield strength increased by at least 30% in cross-section sizes of two inches or less and a hardness increase of at least 50% over ductile iron not containing said antimony or tin.

3. The method as in claim 1, wherein said nodularizing agent is comprised of at least one of magnesium, calcium or lithium.

4. In a method of making an as-cast ductile iron casting from a melt comprising 3.0–4.1% carbon, 1.8–2.8% silicon, 0.5–0.8% manganese, no greater than 0.015% sulfur, no greater than 0.06% phosphorus and the remainder being iron, the casting having an increased yield strength, hardness and fatigue resistance, the steps comprising:

alloying with said melt, by percentage weight of the melt, the following ingredients: at least one of 0.02–0.04% antimony and 0.02–0.06% tin, 0.001–0.0015% each of Ce and La, said ingredients and manganese together constituting 0.2–1.0% of the melt; and treating said alloyed melt with a nodularizing agent so that upon cooling the resulting cast iron will contain a pearlitic matrix having uniformly distributed graphite nodules with the nodules surrounded by ferrite as well as cementite.

5. The method as in claim 4, wherein said tin or antimony is added in an elemental form.

6. The method as in claim 4, wherein Ce and La are added in alloyed form as mangnesium ferro silicon with Ce and La.

7. The method as in claim 4, wherein said manganese is added as iron manganese alloy.

8. The method as in claim 1, wherein said casting has a tensile strength consistently in excess of 90,000 psi.

9. A method of strengthening ductile iron by alloying the ductile iron matrix with (a) at least one of 0.02–0.06% by weight Sb and 0.02–0.08% Sn, and (b) 0.5–1.0% Mn.

* * * * *